United States Patent [19]

Alberici et al.

[11] Patent Number: 5,076,813

[45] Date of Patent: Dec. 31, 1991

[54] HIGH-ENERGY-CONTENT FUEL COMPOSITION CONTAINING QUADRICYCLANE

[75] Inventors: Fausto Alberici, Peschiera Borromeo; Luigi Cassar, San Donato Milanese; Fabio Monti, Rome; Carlo Neri, San Donato Milanese; Nereo Nodari, Spino D'Adda, all of Italy

[73] Assignees: Enichem Synthesis S.p.A., Palermo; Agip Petroli S.p.A., Rome, both of Italy

[21] Appl. No.: 586,573

[22] Filed: Sep. 21, 1990

[30] Foreign Application Priority Data

Sep. 26, 1989 [IT] Italy ..... 21837 A/89

[51] Int. Cl.[5] ..... C07C 13/28

[52] U.S. Cl. ..... 44/300; 585/14; 585/22

[58] Field of Search ..... 44/300; 585/14, 22

[56] References Cited

U.S. PATENT DOCUMENTS

| | | | |
|---|---|---|---|
| 3,390,197 | 6/1968 | Erman et al. | 585/22 |
| 3,662,008 | 5/1972 | Kretschmar et al. | 585/22 |
| 4,270,014 | 5/1981 | Norton et al. | 585/22 |

OTHER PUBLICATIONS

Organic Synthesis, vol. 51, p. 133, "Quadricyclane".

*Primary Examiner*—Prince Willis, Jr.
*Assistant Examiner*—M. Nuzzolillo
*Attorney, Agent, or Firm*—Shea & Gould

[57] ABSTRACT

A high-energy-content fuel composition, for controlled-ignition internal combustion engines, contains quadricyclane (tetracyclo-[2.2.1.0-(2,6).0-3,5]-heptane), for which a new synthesis method is proposed.

The use of the quadricyclane-containing fuel composition makes it possible a larger amount of energy to be available per each fuel volume unit, and favorably modifies the combustion kinetics in controlled-ignition internal combustion engines.

4 Claims, No Drawings

HIGH-ENERGY-CONTENT FUEL COMPOSITION CONTAINING QUADRICYCLANE

The present invention relates to a fuel composition for controlled-ignition internal combustion engines, which contains quadricyclane (tetracyclo-[2.2.1.0-(2,6).0-3,5]-heptane) and has a high energy content, in particular a higher energy content than of usual gasolines.

The present invention relates furthermore to a new, simple, cheap method for producing quadricyclane.

Commercial gasolines, normally used for powering cars or other vehicles, are constituted by hydrocarbon mixtures which distil by at least 95% by volume at temperatures not higher than 225° C., obtained from petroleum or petroleum fractions.

Commercial gasolines are characterized by a certain number of properties, such as specific gravity, volatility, stability and absence of corrosive power. Other important characteristics for combustion are heating value, latent evaporation heat, knocking and preignition resistance.

Among all these characteristics, the heating value—i.e., the amount of energy supplied by a given amount of fuel which is converted into work—is of primary importance.

The useful net heating value of fuel from petroleum ranges within narrow limits and is of the order of from 10,200 to 10,500 kcal/kg.

Therefore, having available fuel compositions endowed with a higher heating value than of commercial fuels results interesting, because in that way one has available a larger energy amount per each given amount of transported fuel, and/or, with the available energy amount being the same, the overall volume of transported fuel is smaller.

Fuel compositions endowed with a high energy content, for use in internal combustion engines, have been proposed also recently.

Such compositions generally contain at least one cycloaliphatic, saturated or unsaturated hydrocarbon, which can be monocyclic, and more frequently is polycyclic with condensed rings, whose molecule contains at least one three-membered and/or four-membered ring. Such configurations guarantee a strain energy of at least about 25 kcal/mol.

Among the patent documents which disclose fuel compositions containing cyclic hydrocarbons of different natures, we mention, e.g., U.S. Pat. No. 2,407,717 in which fuel compositions for jet aircrafts are disclosed, which are based on monocyclic hydrocarbons whose molecules contain ring of 3 or 4 carbon atoms. Among such compounds, trimethylcyclopropane is claimed.

U.K. patent 836,104 defines on the contrary enhanced-energy-content fuel compositions containing mixtures of bicyclic and polycyclic hydrocarbons, suitable for the same uses as above mentioned.

In French patent 1,435,267 mixtures of hydrocarbons are claimed, which contain tricyclononane and/or its alkyl-substituted derivatives, and in French patent 1,435,268 the same Applicant discloses mixtures based on bicyclononanes.

The present Applicant has found now, and this constitutes a first aspect of the present invention, that a fuel composition with a higher heating value than of commercial gasolines, suitable for use in internal combustion engines of cars or of other vehicles in which high performances are required, as well as for all those uses in which a larger energy amount per unit fuel volume is required, can be easily obtained by means of the addition of suitable amounts of a tetracyclic hydrocarbon and/or its alkyl derivatives, having a strain energy higher than 90 kcal/mol, to normal gasolines or traditional fuel mixtures.

Said hydrocarbon is tetracyclo[2.2.1.0-(2,6).0-3,5]-heptane, commonly denominated quadricyclane, which is liquid under room conditions, is perfectly mixible with the combustible hydrocarbons normally used in internal combustion engines, and displays physical characteristics, such as a boiling point value (B.P. = 108° C.) and a density value (d = 0.98 g/cm$^3$), which render it suitable for the proposed use.

As above said, quadricyclane has a very high strain energy (94 kcal/mol), due to the particular degree of stressing of carbon-carbon bonds inside its molecule, which is the main responsible for the energy content increase observed in mixtures which contain it.

Quadricyclane can be prepared by means of methods known in the art, e.g., by means of the method described in Organic Synthesis 1971, vol. 51, pages 133–136. According to one of the most direct among reported methods (J. Amer. Chem. Soc. 1961, vol. 83, pages 4671–4675), hydrocarbon solutions of norbornadiene are irradiated in the presence of acetophenone.

The present applicant has found now, and this constitutes a second aspect of the instant invention, that quadricyclane can be directly synthetized with extremely high values of yield and selectivity, close to the theoretical value, by means of the direct irradiation of norbornadiene in a photochemical reactor containing a high-pressure mercury vapour lamp and in the presence of small amount of Michler's ketone (bis-4,4'-dimethylaminobenzophenone). According to as it results from the example reported at the end of the instant text, and with the herein proposed method, conversions of 99% of bornadiene with 99% selectivity to quadricyclane are obtained.

The productivity resulted high as well (40 g/hour.kW).

As compared to the methodologies pointed out in the literature cited hereinabove, our process, which, as said, constitutes a further aspect of the instant invention, shows the following advantages:

- The synthesis is directly carried out in bulk, without the aid of solvents, hence with no need of distillations in order to remove them.
- Thanks to higher conversion selectivities, one can operate with higher productivities per time unit than the data reported in the literature.
- No distillations for photosensitizer removal are necessary, in that the photosensitizer is contained in the reaction mass in very small amounts.
- The synthesis is carried out by starting from commercial products, and the purification of norbornadiene used as the starting product is no longer necessary.

For the purposes of the present invention, use of quadricyclane is preferred rather than of its substituted homologues. However, also alkyl-substituted derivatives thereof can be used, on condition that their substitution degree is low.

For the purposes of the instant invention, compositions are suitable which contain quadricyclane and/or its alkyl-substituted derivatives and toluene, or a normal gasoline.

In particular, the gasolines which can be used in the compositions according to the present invention are those which are constituted by a mixture of hydrocarbons distilling for at least 95% by volume at temperatures not higher than 225° C., obtained from petroleum by distillation, or from petroleum cuts by means of thermal or catalytic treatments. Examples of such gasolines are reforming gasoline, cracking gasoline, polymerization gasoline, alkylation gasoline and stabilized gasoline.

In these compositions, volumetric ratios of toluene or gasoline to quadricyclane comprised within the range of from 90:10 to 10:90, and preferably comprised within the range of from 70:30 to 50:50, should be adopted.

The fuel compositions according to the present invention can additionally contain those additives which are usually added to fuels for controlled-ignition internal combustion engines.

As said, the use of the fuel composition according to the present invention makes it possible, as compared to normal fuels, to have available a higher amount of energy per each given amount of transported fuel, and/or to reduce the overall dimensions of transported fuel, with available energy being the same. These characteristics can be advantageously used above all in racing cars, for which the best compromise between delivered power, and limited weights and overall dimensions, is constantly sought for. The present Applicant found that the use of the compositions the present invention as fuel for controlled-ignition internal combustion engines makes it surprisingly possible the combustion kinetics to be favourably modified, as it will be evident from the following example, reported for the purpose of better illustrating the present invention.

EXAMPLE 1

Synthesis of Quadricyclane 110 g of norbornadiene at 97% and 0.1 g of Michler's ketone (bis-4.4'-dimethylamminobenzophenone) are charged under nitrogen to a photochemical reactor containing a 150-Watt lamp (high pressure mercury vapour lamp).

37 hours later, the gas-chromatographic analysis of the solution shows a conversion of 99%, with a selectivity value of 99%.

The productivity is of about 40 g/hour.kW

EXAMPLE 2

The performances of the following fuels in an engine are evaluated:

(A) toluene (comparative product)

(B) composition containing 70% by volume of toluene and 30% by volume of quadricyclane (C) composition containing 50% by volume of toluene and 50% by volume of quadricyclane The experimental tests are carried out on a single-cylinder laboratory engine having the following characteristics:

| | |
|---|---|
| Engine | RICARDO "HYDRA" |
| Type | single cylinder/vertical/aspired |
| Feed | Injection |
| Injection pump | Mico Bosch "A" type |
| Fuel pressure | 2 bar |
| Compression ratio | 9.1:1 |
| Displacement | 447 cc |
| Stroke | 88.90 mm |
| Bore | 80.26 mm |
| Max. speed | 5,400 rpm |

In particular, engine performance is evaluated in terms of delivered power and fuel consumption under conditions of fully opened throttle valve at the speed of 5,400 rpm. For each composition, the optimum conditions of such parameters as "spark advance" and "mixture strength" (A/F=weight ratio of air to fuel) are sought for. Found values are reported in following table.

| OPTIMUM CONDITIONS | Composition (A) | (B) | (C) |
|---|---|---|---|
| Torque (Nm) | 26.3 | 26.9 | 27.3 |
| Power (kW) | 14.87 | 15.21 | 15.43 |
| Specific consumption (g/kW · hour) | 383 | 367 | 356 |
| Mixture strength (A/F) | 12.46 | 12.68 | 12.82 |
| Spark advance (output shaft degrees) | 42 | 40 | 38 |
| *Speed | | 5,400 rpm | |
| *Throttle | | fully opened | |

We claim:

1. Fuel composition with a high energy content for controlled-ignition internal combustion engines, comprising (i) tetracyclo(2.2.1.0-(2,6).0-3,5)-heptane (quadricyclane), its alkyl-substituted derivatives, or a combination of the foregoing and (ii) gasoline or toluene.

2. Composition according to claim 1, wherein the volumetric ratio of toluene or gasoline to the tetracyclo (2.2.1.0-(2,6).0-3,5,)-heptane (quadricyclane), its alkyl-substituted derivatives, or a combination of the foregoing is comprised within the range of from 90:10 to 10:90.

3. Composition according to claim 2, wherein said ratio is comprised within the range of from 70:30 to 50:50.

4. A method of controlling ignition in internal combustion engines comprising combusting a fuel comprising tetracyclo(2.2.1.0-(2,6).0-3,5)-heptane (quadricyclane), its alkyl-substituted derivatives, or a combination of the foregoing, and gasoline or toluene.

* * * * *